United States Patent [19]

McGregor

[11] 4,432,186

[45] Feb. 21, 1984

[54] AUTOMATIC BAG HANGER

[76] Inventor: Harold R. McGregor, 1234 Brady Blvd. P.O. Box 710, Owatanna, Minn. 55060

[21] Appl. No.: 289,803

[22] Filed: Aug. 3, 1981

Related U.S. Application Data

[63] Continuation-in-part of Ser. No. 146,303, May 5, 1980, Pat. No. 4,322,932.

[51] Int. Cl.[3] ..... B65B 43/18

[52] U.S. Cl. ..... 53/69; 141/114; 141/314; 53/266 R; 53/386; 53/573

[58] Field of Search ..... 53/570, 573, 571, 373, 53/266 R, 386, 384, 468, 469, 69, 67; 141/114, 313, 314, 312, 315, 10

[56] References Cited

U.S. PATENT DOCUMENTS

| | | | |
|---|---|---|---|
| 3,423,903 | 1/1969 | Miller, Jr. | 141/315 X |
| 3,673,759 | 7/1972 | Ayres et al. | 53/573 X |
| 3,830,038 | 8/1974 | Propst | 53/573 X |
| 3,884,278 | 5/1975 | Nakashima | 141/114 X |
| 3,989,073 | 11/1976 | Remmert | 141/315 |
| 4,310,037 | 1/1982 | Seals | 141/315 X |
| 4,322,932 | 4/1982 | McGregor | 53/505 |
| 4,334,558 | 6/1982 | Durant | 141/114 |
| 4,345,629 | 8/1982 | Inglett, Jr. | 141/313 X |

*Primary Examiner*—James F. Coan

*Attorney, Agent, or Firm*—Williamson, Bains, Moore & Hansen

[57] ABSTRACT

Apparatus for filling bags and providing completely controlled handling of bags from pickup through their movement to a bag closing station. A pair of elongated forming bars supported for up and down movement and traversing movement between a bag filling hopper and a laterally spaced bag closing station grip, flatten, and assist in forming gusseted bags after filling while the bags are still clamped on a filling spout, and thereafter controllably lower the filled bags to a conveyor and support the bags on the conveyor in traversing movement to a final bag closing station. A pair of gusset arm assemblies supported for lateral shifting movement on opposite sides of a filling spout each include a pair of gusset clamping fingers which are disposed inside of the mouth of a bag during filling. The clamping fingers are actuated in a predetermined sequence to hold and form the gusset pleats of the bag while permitting the bag to be opened over its full width during the filling operation. Accurate closing is assured by continuous gripping of the bag at all times.

10 Claims, 25 Drawing Figures

16
16
19
19
200
202
282
2
4

AUTOMATIC BAG HANGER

CROSS REFERENCE TO RELATED APPLICATIONS

This application is a continuation-in-part of my application Ser. No. 06/146,303 filed May 5, 1980 now U.S. Pat. No. 4,322,932.

BACKGROUND OF THE INVENTION

This invention relates to bag handling machines of the type including a hopper from which particulate material is dispensed in predetermined quantities or batches through a spout having a discharge end on which a bag is hung for filling. Such bag filling apparatus normally includes clamps carried on the spout movable to a clamping position to hold a bag during the filling operation. See, for example, U.S. Pat. No. 4,078,358.

It is also known to utilize pivotal stretcher arms to elongate the mouth of a bag upon filling; and prior art bag filling machines have included flat rods or bars swingable against the front and back faces of a bag to assist in flattening and closing a bag neck after filling. Such features are disclosed in the aforesaid U.S. Pat. No. 4,078,358 as well as in U.S. Pat. Nos. 2,732,988 and 3,896,605. The latter patent also discloses a pivotal guide rod movable into a horizontal position to assist in supporting a filled bag against a fixed member as the bag is conveyed to a bag closing device. Reference is also made to U.S. Pat. No. 3,889,449 which discloses the distension of a bag while on a filling spout to separate the front and rear edges of the bag for entry of an air blast.

Although previously known and used bag filling machines have been satisfactory to a degree in the filling of bags with particulate material and in the handling of such bags in their movement to a bag closing station, there are no known prior bag filling and handling machines which completely satisfactorily form and hold a bag neck during and immediately after filling on a filling spout and thereafter hold the bag neck in a flattened, properly formed position for presentation to a bag closing device. This is particularly true with respect to the filling of gusseted bags, and prior art bag filling and handling machines are lacking in the provision of means for providing totally controlled handling of filled gusseted bags from the time of pickup to the time when it is introduced at the input side of a bag closing machine, such as a sewing machine. In particular, pinch bottom bags require a great deal of precision in handling to form a seal having the requisite integrity.

BRIEF SUMMARY OF THE INVENTION

Having in mind the foregoing status of the prior art and the shortcomings therein with respect to the filling and handling of bags, I have developed an improved bag filling and handling machine which is particularly characterized by the fully controlled pickup, forming and handling of a bag during filling with particulate material from a hopper on an elevated spout, during lowering movement onto a conveyor after filling, and during traversing movement on the conveyor to a bag closing station.

The bag filling and handling apparatus of this invention has been particularly developed with a view towards the filling and handling of gusseted bags.

Initially, a stack of bags are loaded onto a rollable pallet which is rolled onto a forklift which lifts the pallet into position. There, a swing arm having vacuum cups thereon picks up the top bag from the stack and, as the swing arm swings upwardly, a clamping arm clamps the bag to the cups whereupon the suction is released. When the swing arm reaches a vertical position, the clamp is released allowing the bag to drop into a curved chute which deposits the bag onto a table for pickup.

A swinging carriage is mounted above and swings parallel to the length of the table. Attached to the front end of the carriage are two hanger arms which pivotally swing from the carriage. A pusher bar attached to the rear end of the carriage serves to push the bag forward into a registry position wherein the bag may be picked up by the hanging arms. A registry plate may be employed to insure that the front edge of the bag is exactly at the desired registered position as the position of this top edge of the bag is extremely important in obtaining a proper seal, particularly with the pinchbottom bags. The two hanger arms have movable clamps on the ends thereof which clamp on each side of the bag adjacent the top of the bag. Each hanger arm also includes vacuum cups to slightly draw open the mouth of the bag for ease of hanging on the filling apparatus. The hanger arms may also be stretched apart by a hydraulic cylinder in order to make sure that the bag is taut between the arms.

The bag hanging motion takes place in two steps. First, as the carriage swings forwardly, the first stage of a two-stage hydraulic cylinder swings the hanger arms outwardly (while gripping the bag) so that the bag is located close to but separated slightly from the filling station. Thus, the bag ready to be hung in the filling station need only travel the short distance provided by the second stage of the hydraulic cylinder in order to be hung on the filling apparatus. This two-stage operation is important in maximizing the capacity of the machine and minimizing wasted time. It is also extremely important that the clamps on the hanger arms are not at all released until the various clamp mechanisms of the filling apparatus have been operated thereby insuring that the bag remains in proper registry throughout the operation thereby insuring a proper seal.

The improved forming of such bags during filling is advantageously achieved by a pair of vertically oriented arm assemblies positioned on opposite sides of a filling spout for lateral shifting movement towards and away from each other inside of a bag clamped on a spout. The arm assemblies are moved across the width of a bag in a direction generally perpendicular to the clamping path of movement of clamp means utilized to clamp a bag mouth on the discharge end of the spout.

Each of the aforesaid arm assemblies preferably includes a pair of gusset clamping fingers operable by actuating means to sequentially clamp and release the inside of the gusset pleats of gusseted bags at predetermined lateral positions of the arm assemblies during the filling of a bag. The lateral shifting movement of the gusseted clamping fingers is automatically controlled in coordination with the opening and closing of the filling spout. As a result, the clamping fingers support the gusseted sides of the bag in upright position and hold the pleated form of the gussets while permitting the bag to be distended to the maximum extent possible during filling.

A further beneficial feature resides in the adjustable mounting of both the aforesaid arm assemblies and the power cylinders which operate to laterally shift the arm assemblies for lateral adjustment towards and away from the sides of the filling spout. This permits the optimum positioning of the clamping fingers carried on the arm assemblies for different width bags.

The objective of controlled handling during all movement of a filled bag from a filling spout to a closing station is advantageously accomplished by a pair of laterally and generally vertically movable forming bars which are movable by actuating means towards and away from each other for gripping engagement with the front and rear faces of a bag. Drive means are controllably operated in a predetermined sequence to move the forming bars under the filling spout at the conclusion of a bag filling operation so as to bring the pair of forming bars in embracing juxtaposition to the top end of a billed bag. Thereafter, the forming bars are actuated to move towards each other to firmly grip a filled bag and press its front and back faces closed at the top end thereof. The forming bars are then moved downwardly to controllably lower a filled bag onto a conveyor after which the aforesaid drive means transversely moves the forming bars back towards a rest position adjacent to a bag closing station, such as a sewing machine. The forming bars move along with the conveyor and support the bag as it is transported to the bag closing station with its top end held in a flat, closed position by the forming bars.

As a particularly significant aspect of the aforesaid apparatus, the movement of the forming bars and the gusset clamping fingers is coordinated so that the clamping fingers are in an outwardly shifted position in clamping engagement with the inside of gusset pleats of a bag on opposite sides thereof while the bag is still clamped on a filling spout at the time when the forming bars are moved inwardly to grip the front and back faces of the bag neck. The bag is thus gripped by the forming bars before it is released from the filling spout, and the forming bars and gusset clamping fingers cooperate to hold and form the gusseted sides of a bag in flattened, gusset pleats prior to the movement of a filled bag to a bag closing station.

These and other objects and advantages of the improved bag filling and handling apparatus set forth herein will be readily understood as the following description is read in conjunction with the associated drawings wherein like reference numerals have been used to designate like elements throughout the several views.

DESCRIPTION OF THE PREFERRED EMBODIMENT

Figure 1:
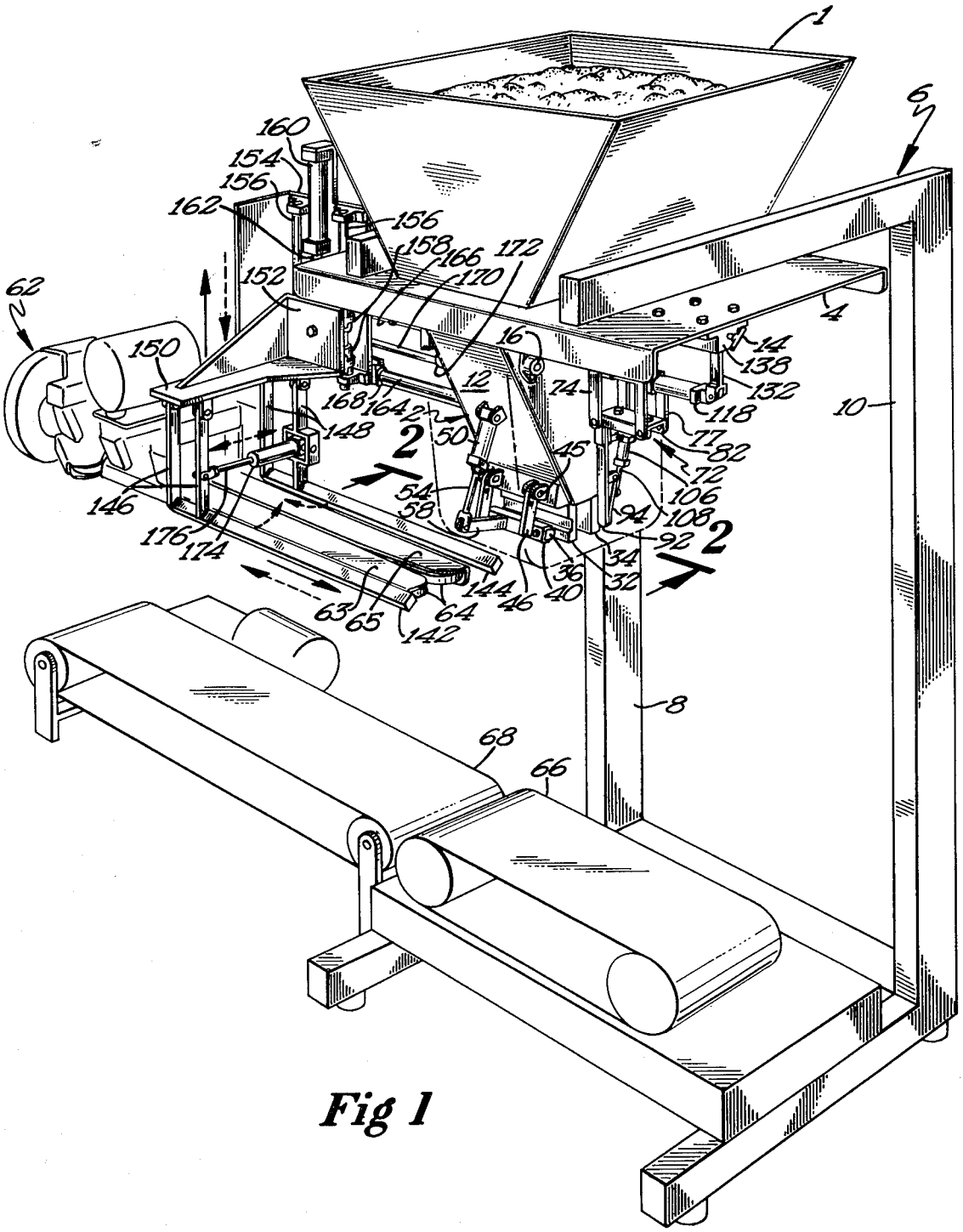
FIG. 1 is a front, perspective view of the improved bag filling and handling apparatus of this invention.

With reference to the drawings, FIG. 1 shows the improved bag filling, forming, and handling apparatus of this invention as positioned for operation with respect to a material supply hopper 1 having a dispensing spout 2 thereunder. Hopper 1 may be of a well known type which holds particulate material, such as seed, feed, or fertilizer, and which incorporates a net weight scale for releasing predetermined quantities of material into spout 2. Hopper 1 and spout 2 are supported on a deck 4 of a supporting frame assembly generally indicated by reference numeral 6. The frame assembly includes a pair of upright pedestals 8 and 10 on which deck 4 is supported.

Figure 2:
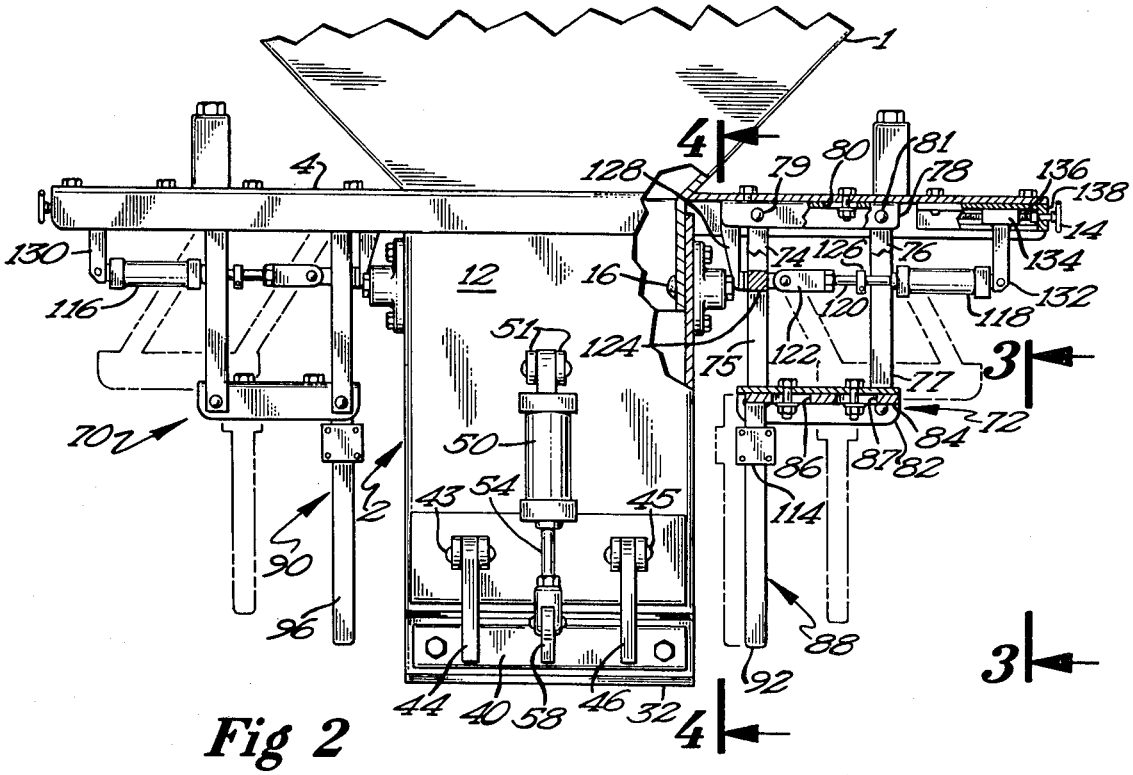
FIG. 2 is a front, elevation view of the bag filling portion of the apparatus taken along lines 2—2 of FIG. 1.
Figure 4:
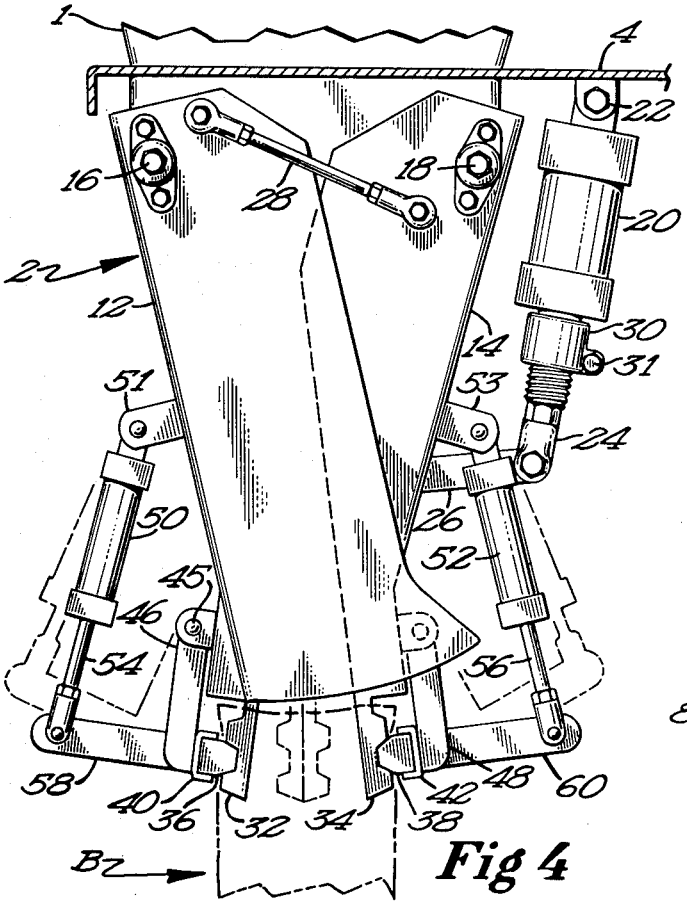
FIG. 4 is a fragmentary, side elevation view of the bag filling apparatus taken along lines 4—4 of FIG. 2.

As may best be understood by reference to FIGS. 2 and 4, as well as FIG. 1, spout 2 is preferably of the well known, clam shell construction having a pair of clam shell halves 12 and 14 which are pivotal between open and closed positions about pivot pin connections 16 and 18 to the lower end of hopper 1. Power means preferably in the form of a double-acting fluid cylinder 20 pivotally supported on deck 4 at pivot pin 22 is utilized to actuate spout clam shell sections 12 and 14 between open and closed positions. To this end piston 24 of cylinder 20 is connected by a link 26 to one side of clam shell section 14. A connecting rod 28 extends between the upper ends of clam shell sections 12 and 14 whereby the pivotal movement of clam shell section 14 by the extension and retraction of piston 24 is transmitted to clam shell section 12 to permit the clam shell sections to pivot towards and away from each other in opening and closing movement. A split adjusting nut 30 threadedly positioned on connecting rod 24 is adjusted towards or away from the adjacent end of cylinder 20 to serve as a stop for the return or retraction stroke of piston 24. After adjustment to a predetermined position on piston 24, nut 30 is secured in place by tightening a bolt 31 extending through ears thereon. The extent to which clam shell sections 12 and 14 are opened may thus be adjusted for particular size bags by the use of nut 30 to limit the retracting movement of piston 24 on its spout opening stroke. FIG. 4 shows piston 24 retracted and clam shell sections 12 and 14 moved to their open positions.

Depending spout plates 32 and 34 attached to the lower ends of clam shell sections 12 and 14 define the discharge end of spout 2. Spout plates 32 and 34 are pivotal with spout clam shells 12 and 14 between the solid line open position and the phantom line closed position shown in FIG. 4. Bag clamps 36 and 38 in the form of elongated clamping members are supported as shown in FIGS. 1, 2 and 4 so as to be movable into the bag clamping positions shown in FIG. 4 wherein they are received in recesses in spout plates 32 and 34. Thus, clamps 36, 38 and spout plates 32, 34 cooperate to provide bag clamping means between which the front and rear faces of a bag are clamped on the bottom end of spout 2. Bag clamps 36 and 38 are held in channel members 40 and 42 which are carried on arms pivotally attached to the sides of clam shell sections 12 and 14. The pivotal support arms for clamp 36 are illustrated at 44, 46 in FIGS. 2 and 4, these arms being pivotally attached to the lower side of clam shell section 12 by pivot pins 43 and 45. Bag clamp 38 and its channel 42 are similarly supported from the side of clam shell section 14, one of the pivotal support arms for bag clamp 38 being shown at 48 in FIG. 4.

Bag clamps 36 and 38 are moved between the bag clamping and bag release positions shown in FIG. 4 by double-acting, fluid cylinders 50 and 52. These cylinders are pivotally attached to the side walls of clam shell sections 12 and 14 by ears 51 and 53 affixed thereto. Thus, cylinders 50 and 52 also move inwardly and outwardly with clam shell sections 12 and 14 in the course of their opening and closing movemcnt by power cylinder 20. Cylinders 50 and 52 carry reciprocating pistons 54 and 56 which are connected at their lower ends to links 58 and 60. These links are in turn secured to channel supports 40 and 42 for bag clamps 36 and 38. The extension of pistons 54 and 56 moves the bag clamps 36 and 38 inwardly towards spout plates 32 and 34 to a bag clamping position as illustrated in FIG. 4. The retraction of pistons 54 and 56 causes bag clamps 36 and 38 to be pivoted outwardly to bag release positions as illustrated in phantom lines in FIG. 4.

Laterally spaced to one side of dispensing spout 2 is a bag closing station where the top ends of filled bags are closed. The final closing of filled bags may be accomplished in various ways. One type of closure commonly employed is a stitched closure which may be done by a sewing machine generally indicated by reference numeral 62 in FIG. 1. Such a sewing machine may be of the type manufactured by Fischbein Manufacturing Co. as disclosed in U. S. Patent No. 3,747,543. A power guide mechanism as heretofore utilized with such bag stitching machines is provided at the input side of sewing machine 62 and incorporates a pair of closely spaced guide belts or chains 64 rotatably supported within housings 63, 65. The tops of filled bags are received between guide chains or belts 64 which assist in holding the front and back faces of the bag together and in alignment with the stitching needle of the sewing machine. Filled bags are moved into guide chains 64 and thence to the stitching machine 62 by conveyor belts 66 and 68 positioned as shown in FIG. 1 under the bag filling and closing apparatus. The conveyor segment 66 is positioned directly under dispensing spout 2 to receive filled bags moved downwardly after filling. A single continuous conveyor belt could of course be utilized in place of the two conveyor belt segments 66 and 68, and the conveyor belt system will preferably be made vertically adjustable so as to properly position the top ends of bags for closing at sewing machine 62.

Figure 3:
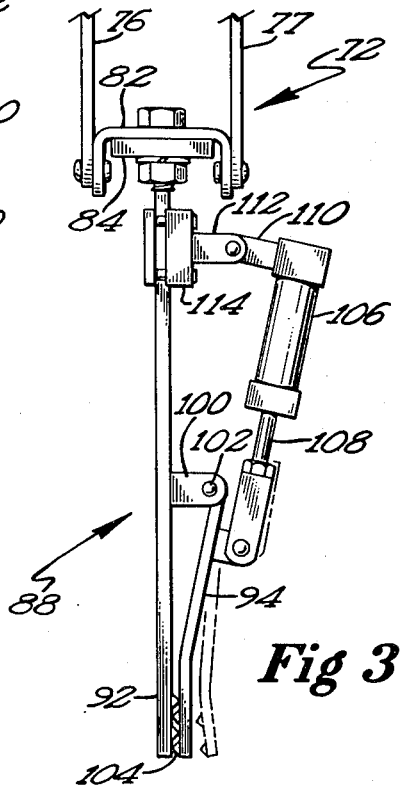
FIG. 3 is a fragmentary, side elevation view of the bag filling apparatus taken along lines 3—3 of FIG. 2.

FIGS. 1, 2, and 3 illustrate a pair of vertically oriented arm assemblies generally indicated by reference numerals 70 and 72 which are positioned on opposite sides of dispensing spout 2. These arm assemblies are provided particularly for the forming and handling of gusseted bags during a filling operation, and for that purpose are located in closely spaced relation to the sides of filling spout 2 as illustrated most clearly in FIG. 2. Since arm assemblies 70 and 72 are identical as to structure and operation, only arm assembly 72 is hereafter described. The support structure for the arm assemblies includes two sets of vertically oriented bracket arms 74, 75 and 76, 77 which are pivotally affixed at their upper ends to an elongated channel member 78 bolted to the underside of deck 4. Reference numerals 79 and 81 in FIG. 2 indicate the pivot pin attachment of bracket arms 74, 75 and 76, 77 to channel member 78. A slot 80 in the top, horizontal segment of channel member 78 permits lateral adjustment of the arm assemblies 70 and 72 towards and away from spout 2. A lower channel bar 82 is horizontally supported on the bottom ends of bracket arms 74, 75 and 76, 77 as shown in FIGS. 2 and 3. A horizontal gusset arm support bar 84 is bolted to the underside of the top, horizontal segment of channel bar 82. Slots 86 and 87 in gusset arm support bar 84 also permit this support device and the gusset arm assembly secured thereto to be laterally adjusted towards and away from spout 2. Attached, as by welding, to gusset arm support bars 84 and depending downwardly thereform, are a pair of gusset arms generally indicated by reference numerals 88 and 90 on opposite sides of spout 2. Each of the gusset arms is comprised of a pair of gusset clamping fingers 92, 94 and 96, 98 with fingers 92 and 96 comprising the bottom ends of gusset arms 88 and 90. Both pairs of gusset fingers 96, 98 and 92, 94 are shown in FIGS. 5 through 12. Each pair of the gusset fingers is supported for pivotal movement relative to each other. In the preferred embodiment as illustrated, gusset fingers 92 and 96 are affixed, and fingers 94 and 98 are pivotally mounted with respect thereto, as is illustrated with respect to gusset clamping finger 94 in FIG. 3. Finger 94 is pivotally mounted on a pivot pin 102 secured to a bracket ear assembly 100 affixed to gusset arm 88. It is contemplated that both gusset clamping fingers 92 and 94 could be supported for pivotal movement towards and away from each other. To assist in gripping the gusset pleats of bags being filled, the gusset fingers may be provided with teeth as shown at 104 in FIG. 3.

Power means, preferably in the form of double acting fluid cylinders, are provided to move pivotal gusset fingers 94 and 98 back and forth towards fixed gusset fingers 92 and 96 to selectively clamp and release the gusset pleats of bags being filled in a predetermined sequence as hereinafter set forth. In FIG. 3 gusset clamping finger 94 is shown in its clamping position in solid lines and in its open position in phantom lines. The actuating cylinder for gusset clamping finger 94 is illustrated at 106 in FIG. 3, piston 108 of cylinder 106 being connected to gusset finger 94 as shown. Cylinder 106 is secured to gusset arm 88 through a link 110 and an ear assembly 112 attached to a bracket 114 bolted onto gusset arm 88.

Power means in the form of double-acting, fluid cylinders 116 and 118 are connected to each of the arm assemblies 70 and 72 for the purpose of imparting lateral, shifting movement thereto. Cylinders 116 and 118 are mounted and attached to their respective arm assemblies 70 and 72 in identical manners, and only the mounting arrangement for cylinder 118 is hereinafter described. Piston 120 of power cylinder 118 is connected by means of a bifurcated coupling 122 to a cross-bar member 124 extending between bracket arms 74 and 75 of arm assembly 72. A stop nut 126 carried on piston 120 is adjustably positioned thereon to contact one end of cylinder 118 at a predetermined point on the return stroke of piston 120 so as to limit the lateral, outward movement of gusset arm 88. This feature, in combination with the other adjustments on the arm assemblies ensures that gusset arms 88 and 90 will be properly positioned at the gusseted sides of a bag being filled, for a particular width bag. A further padded stop device 128 is supported at the inner end of channel member 78 adjacent to the side wall of spout 2. Stop device 128 is positioned to be engaged by the innermost bracket arms 74, 75 so as to stop the inward movement of the arm assemblies towards spout 2 as piston 120 of cylinder 118 is extended. Cylinders 116 and 118 are identically supported from the underside of deck 4 by means of support arms 130 and 132 for lateral adjustment towards and away from the sides of spout 2. As shown in FIG. 2 with respect to cylinder 118, this is accomplished by attaching support arm 132 to a threaded sleeve 134 which is adjustable back and forth on a threaded rod 136 by the rotation of a knob 140 attached thereto. Threaded rod 136 is mounted on a bracket plate 138 bolted to deck 4.

At the start of a bag filling run, the pistons of cylinders 116 and 118 are fully extended to the position shown with respect to piston 120 in FIG. 2 until bracket arms 74, 75 are brought into engagement with stop 128. Thereafter, the entire arm assemblies 70 and 72 are laterally adjusted inwardly utilizing adjusting slot 80 on channel member 78 to position gusset arms 88 and 90 as close as possible to the sides of spout 2. An inwardly adjusted position closer to the sides of spout 2 is shown in phantom lines with respect to gusset arm 92 in FIG. 2. Further adjustment of the gusset arms 88 and 90 in a lateral direction can be achieved by shifting gusset arm support bar 84 back and forth within the ends of its adjusting slots 86 and 87. Final adjustment to ensure that gusset arms 88 and 90 are positioned at their desired inward and outward locations for a particular width bag may be accomplished by use of adjusting knob 140 to laterally shift and position cylinders 116 and 118. It is to be noted that the parallelogram bracket arm support for gusset arms 88 and 90 permits gusset arms 88 and 90 to be shifted generally laterally back and forth as their bracket support arms pivot about points 79 and 81 when cylinders 116 and 118 are operated.

To assist in the forming of bags on the filling spout 2 and to provide for the fully controlled handling of filled bags in their movement to closing machine 62, a pair of forming bars 142 and 144 are provided. As shown in FIG. 1, forming bars 142 and 144 are pivotally suspended on arms 146 and 148 from a carriage assembly. The carriage assembly comprises a horizontal plate 150 and a pair of upright guideplates 152 and 154. Guideplate 154 carries a pair of vertical guide rods 156 which are slidably embraced by bracket sleeves 158 affixed to the rear face of plate 152. Lift cylinder 160 mounted on upright plate 154 has a double-acting piston 162 which is also attached to the rear face of plate 152. Carriage plate 154 is supported for lateral, traversing movement on a pair of horizontal guide bars 164 and 166 by sleeve brackets 168 affixed to the rear face of plate 154. Traversing movement is imparted to plate 154, and therefore to the carriage assembly, by a traversing piston 170 of a double-acting cylinder 172. Forming bars 142 and 144 are pivotally movable towards and away from each other for bag gripping and release as indicated by the dotted arrows in FIG. 1. This is accomplished by a double-acting, actuating cylinder 174 having a piston 176, this piston and cylinder assembly being connected between forming bar support arms 146 and 148.

Figures 15, 17, 18:
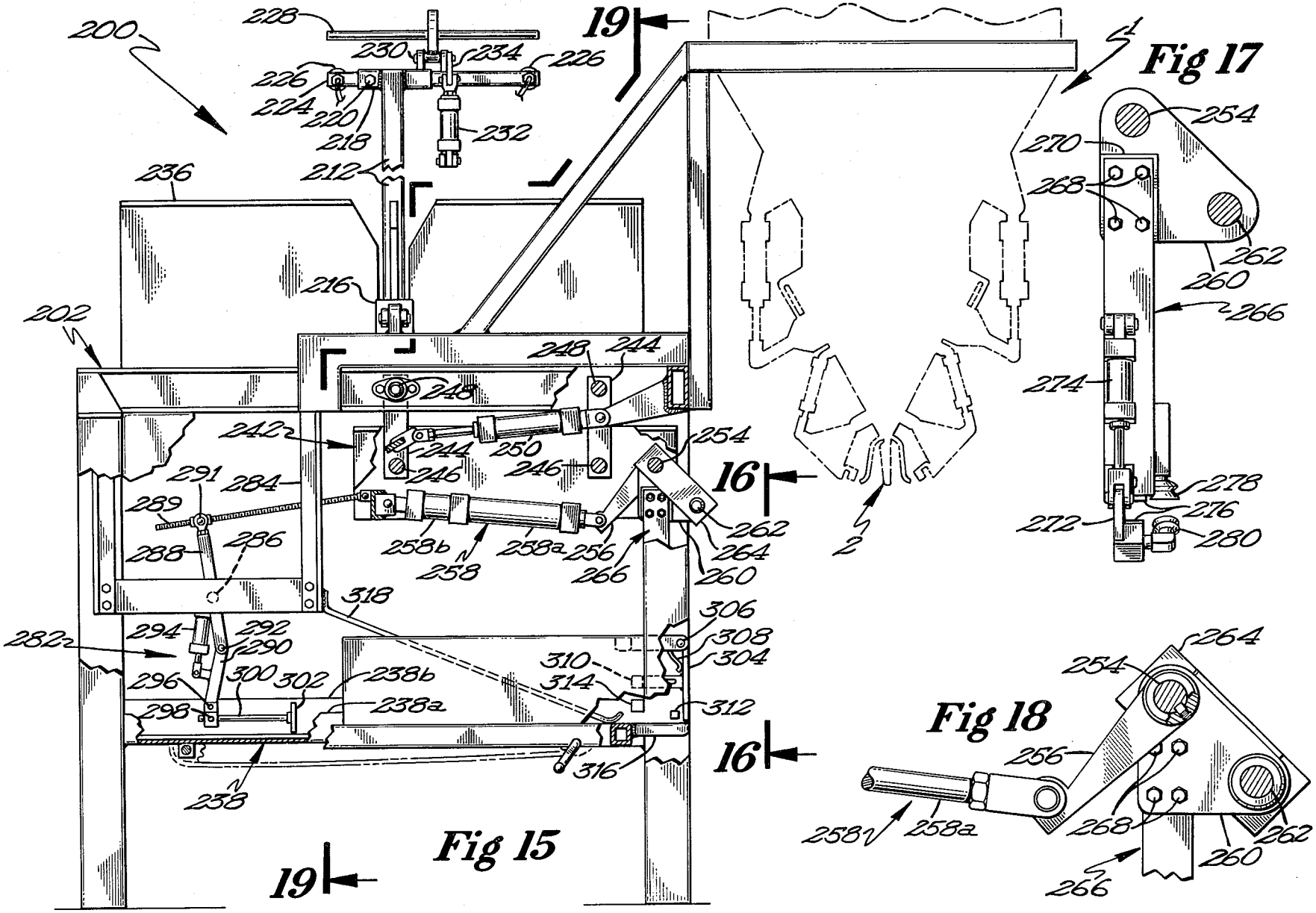
FIG. 15 is a planned view of the bag hanging portion of the invention with the bag filling portion shown in phantom.
FIG. 17 is a sectional view taken along lines 17—17 of FIG. 16.
FIG. 18 is a sectional view taken along lines 18—18 of FIG. 16.
Figure 19:
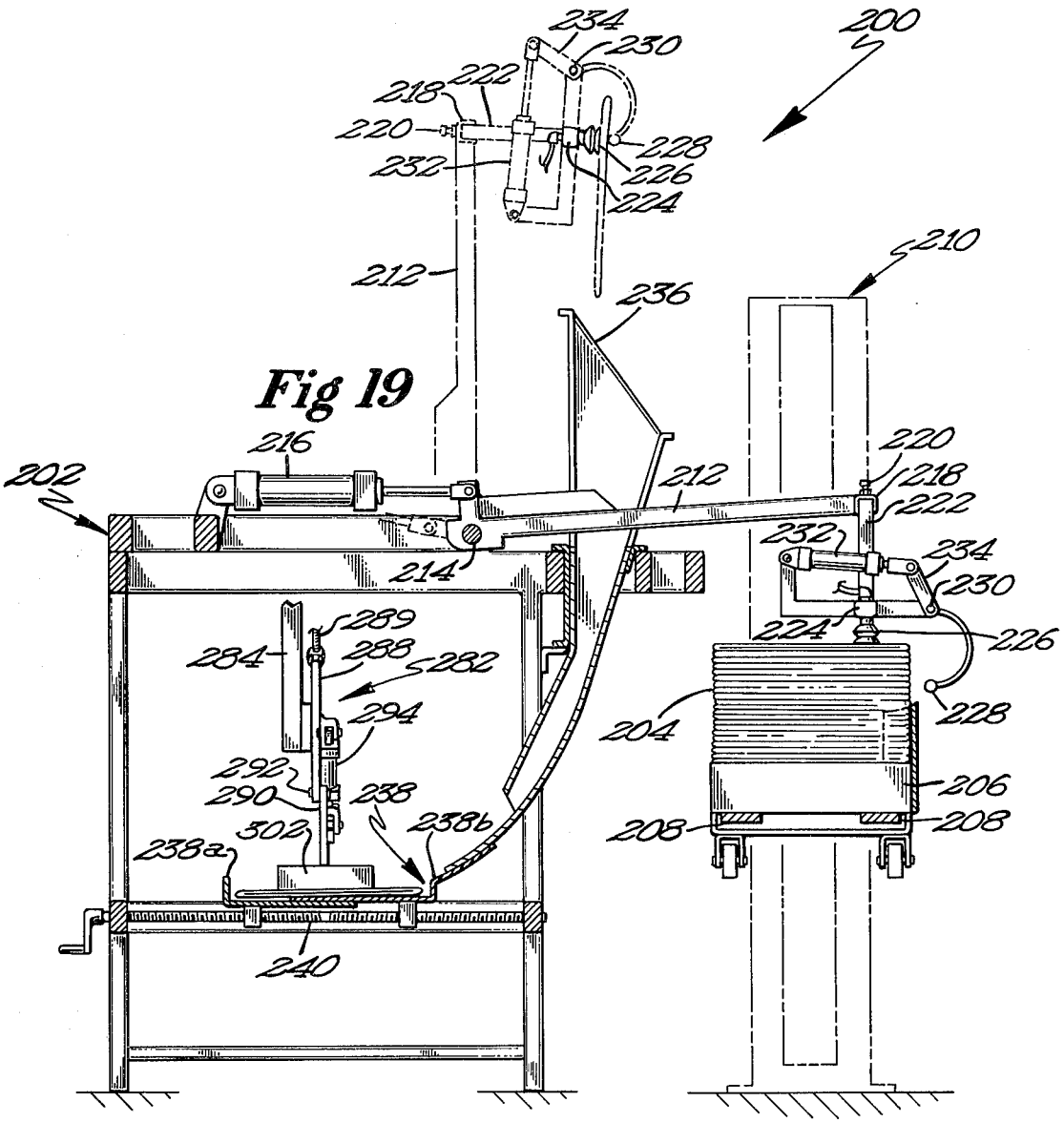
FIG. 19 is a sectional view taken along lines 19—19 of FIG. 15.
Figure 21:
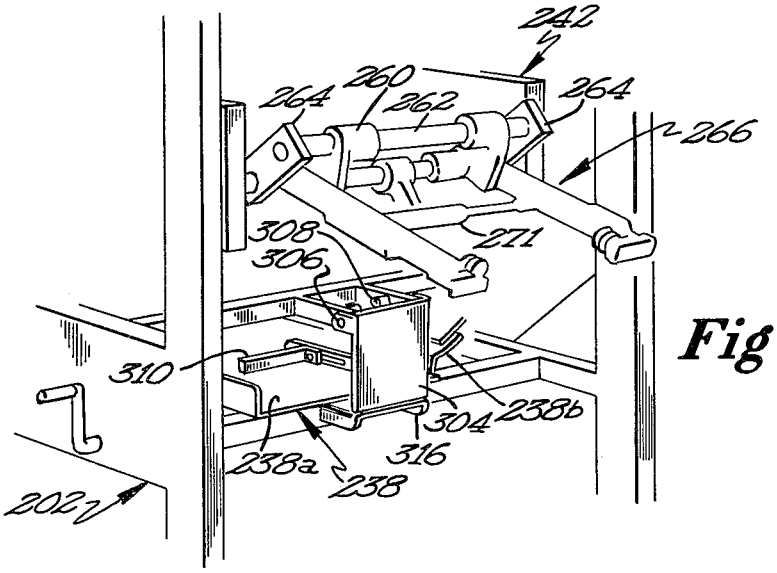
FIG. 21 is a partial perspective view of the hanger arms and facing plate.
Figure 22:
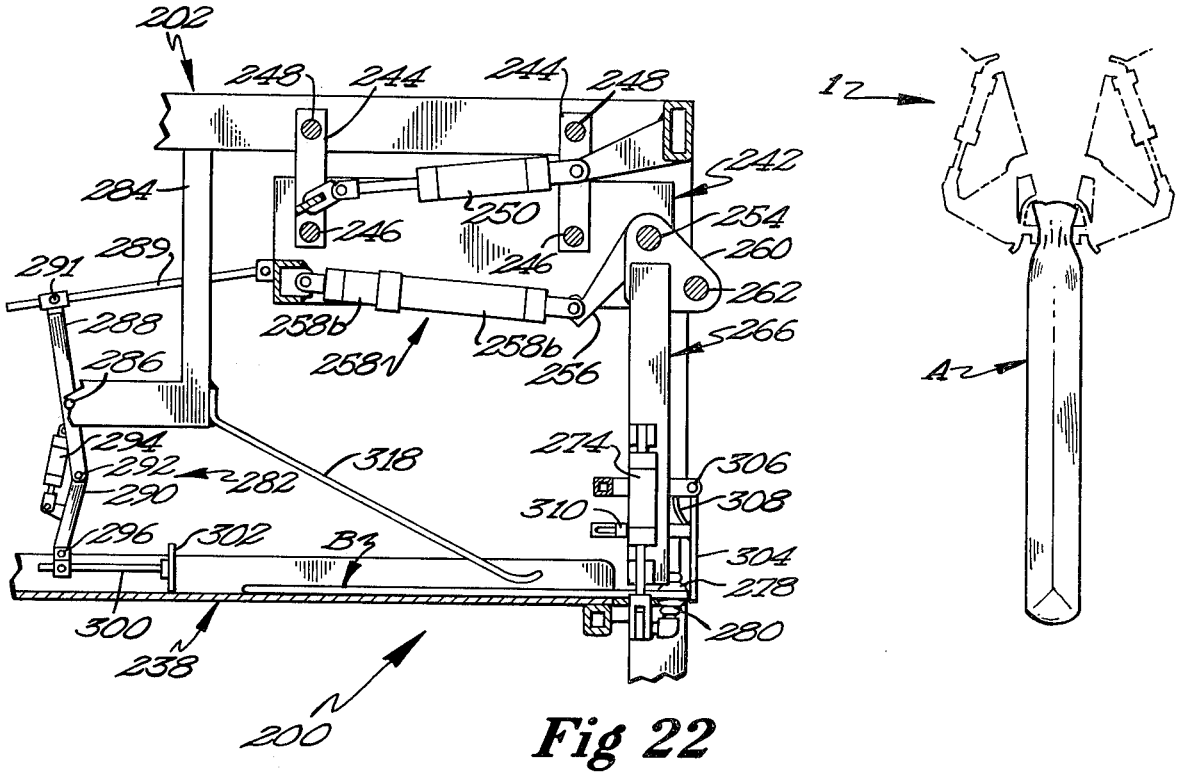
FIGS. 22–25 are partial schematic views showing the invention at various stages of operation.

The bag hanger, generally 200, of the instant invention is shown in FIGS. 15 and 19. Hanger 200 has a generally rectangular frame 202. A stack 204 of bags is loaded onto a wheeled pallet 206 which is in turn slid over forks 208 of forklift 210. Forklift 210 then lifts stack 204 on pallet 206 to a predetermined level such as that shown in FIG. 19 for pickup. Sensing of the predetermined level may be performed by means of photo cells (not shown) on the lift. A swing arm 212 is pivotally mounted to the top of frame 202 at pivot point 214. A hydraulic cylinder 216 serves to actuate swing arm 212 and move it between the positions shown in solid and in phantom in FIG. 19. As used herein, the term hydraulic cylinder is intended to connote cylinders which use gas or liquid as an actuating fluid. The working fluid of choice in such systems is generally air. Swing arm 212 has a tube 218 located at the outer end thereof which has located therein the set screw 220 which locks in place sliding swing arm head 222. Swing arm head 222 has a vacuum bar 224 thereon with vacuum cups 226 located at either end thereof. A clamping bar 228 is pivotably mounted at pivot point 230 to swing arm head 222. Swing arm clamping cylinder 232 actuates an arm 234 which in turn causes the motion of clamping bar 228 against cups 226.

As can be seen particularly in FIG. 19 and to a lesser extent in FIG. 15, a chute 236 is mounted to the side of frame 202 to receive a bag dropped from swing arm 212. Chute 236 is curved in shape and directs the bag downwardly onto table 238 which is formed of two halves **238*a* and 238*b*. Table halves 238*a* and 238*b* are mounted on lead screw 240** which has oppositely threaded halves such that the lead screw may be cranked in order to adjust the table halves inwardly and outwardly.

Figure 16:
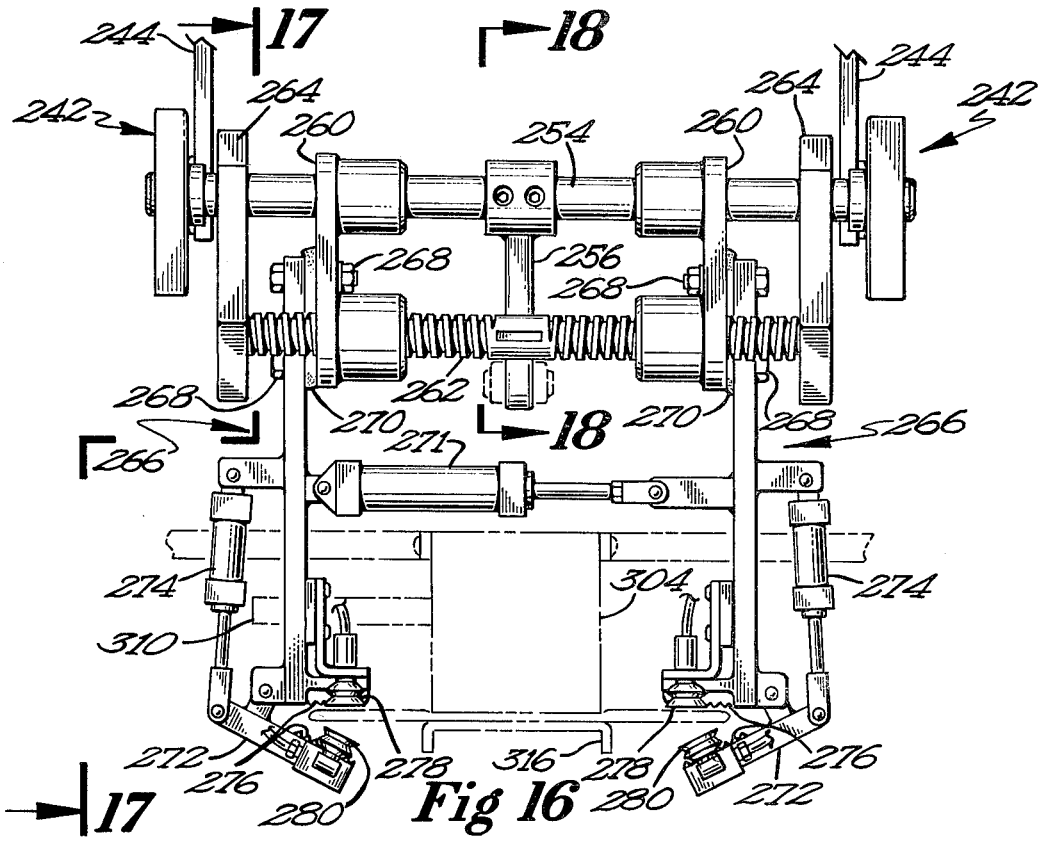
FIG. 16 is a view taken along lines 16—16 of FIG. 15 showing the pickup arm mechanism.
Figure 20:
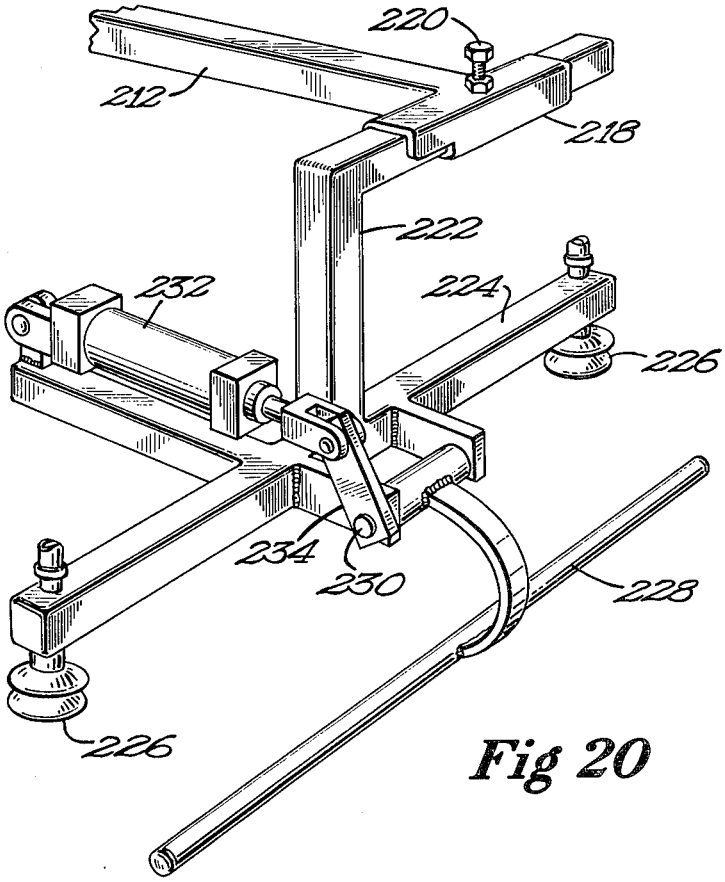
FIG. 20 is a prospective view of the pickup arm.

Turning to FIGS. 15 and 16, a swingable carriage 242 is mounted to carriage arms 244 at pivot points 246. In turn, carriage arms 244 are pivotably mounted to frame 202 at pivot points 248. Carriage 242 is generally rectangular in shape and its movement relative to frame 202 is controlled by carriage cylinder 250. The hanging mechanism, generally 252, is pivotally mounted to carriage 242 along shaft 254. Hanging mechanism 252 is pivoted about axis 254 by means of an actuating arm 256 connected to a two-stage cylinder 258 having a first stage **258*a* and a second stage 258*b*. The other end of two-stage cylinder 258 is pivotably mounted to carriage 242**.

Hanger mounting plates 260 are slidably mounted on shaft 254 at the upper end, end arm lead screw 262 at the lower end thereby providing for adjusting the width of hanger mechanism 252. As can be seen, lead screw 262 is oppositely threaded on the two ends so as to provide coordinated adjustment. End plates 264 are fixably mounted to shaft 254 at their upper end and allow the rotation of lead screw 262 therein at their lower end while confining lead screw 262 so as to impart a rotational motion about shaft 254 to hanger mechanism 252. Hanger arm 266 extends downwardly from mounting plates 260. Hanger arms 266 are mounted to mounting plates 260 by means of fasteners 268 and rubber spacing blocks 270. Spacing blocks 270 allow a slight amount of lateral motion to be imparted to hanger arm 266 by means of cylinder 271 which is mounted between hanger arms 266. Spread cylinder 271, when actuated, serves to insure the tautness of the bag as will be more fully described hereinafter.

Pivotably mounted on the bottom end of hanger arms 266 are clamping arms 272. Clamping arms 272 are actuated by means of clamping cylinders 274 mounted on the outer side of hanger arms 266. Rubber gripping pads 276 are located both on the bottom side of hanger arms 266 and on the top side of clamp arms 272. Fixed vacuum cups 278 and movable vacuum cups 280 are connected to a vacuum source with fixed cups 278 being located at the bottom end of hanger arms 266 and movable cups 280 being located on clamp arms 272. Cups 278 and 280 serve to slightly draw open the mouth of the bag once it is clamped in order to ease the hanging of the bag on the filling chute.

A pusher mechanism 282 serves to push the bag into position as will be more fully described hereinafter. Pusher mechanism 282 is mounted generally on a pusher frame 284 which is in turn mounted to frame 202. Pusher mechanism 282 is pivotally mounted at pivot point 286 on frame 284. Pusher upper link 288 is mounted intermediately on pivot point 286 and on its upper end at pivot point 291 to connecting rod 289 which is in turn attached to carriage 242. The lower end of upper link 288 is pivotally attached to pusher lower link 290 at point 292. The angle between upper link 288 and lower link 290 is controlled by cylinder 294 which is mounted therebetween. A clamp member 298 is pivotally mounted at the lower end of lower link 290 at pivot point 296, and clamp member 298 in turn clamps pusher rod 300 which terminates in pusher plate 302. Pusher plate 302 rests on table 238 as shown in FIGS. 15 and 19.

A registry plate 304 is hinged at pivot point 306 to frame 202. Registry plate 304 hangs downwardly over ledge 316 which extends forwardly from table 238 yet is of a width narrow enough to accommodate hanger arms 266 on either side thereof. Registry plate 304 is retained from backwards motion by spring stop 308 shown in FIG. 15. Hanger return arms 310 extend rearwardly from facing plate 304 and are so configured as to cause plate 304 to assume the position shown in FIG. 15 when hanger arms 266 are in the position shown therein. Also, rod 318 is attached to pusher frame 284 to help guide the bag.

If desired, registry plate 304 described above may be augmented or replaced by a facing mechanism having one or more photocells 312 located at the registry position (that is the desired position in which the bag should assume prior to being picked up) and an extendable rubber bumper stop 314 which, upon the bag registering with photocell 312 extends downwardly to arrest the travel of the bag across table 238.

In operation, the bag hanging mechanism may be described in two separate parts, the first of which is the bag pickup. For pickup, FIG. 19 shows swing arm 212 in solid in the pickup position wherein vacuum cups 226 grip the top bag on stack 204 on pallet 206. Thence,swing cylinder 216 retracts causing swing arm 212 to swing upwardly toward the position shown in phantom. As swing arm 212 swings clear of stack 204, clamp cylinder 232 extends causing clamp bar 228 to clamp the bag against cups 226. At the point where this clamping is taking place, the vacuum is released from cups 226 with the sole retaining force being provided by clamping bar 228. When swing arm 212 assumes the vertical position shown in phantom in FIG. 19, clamp cylinder 232 retracts, thereby dropping the bag into chute 236.

The operation of the remainder of the bag hanging is shown in schematic form in FIGS. 22 through 25. It should be realized that the instant invention is designed to operate in a continuous fashion and hence various bags are always present at various stations in the system. Initially, in FIG. 22, a bag A is clamped to spout 2 and is in the process of being filled. At the same time, a bag B is lying on table 238 and is shown in the registry position whereby the front edge of bag B is at the desired location. Clamping cylinders 274 are extended on clamping arms 272 and are in clamping relationship with the first and second sides of the top of bag B. Carriage 242 is in its retracted position as is swing arm cylinder 258. Carriage cylinder 250 is in an extended position.

Figure 23:
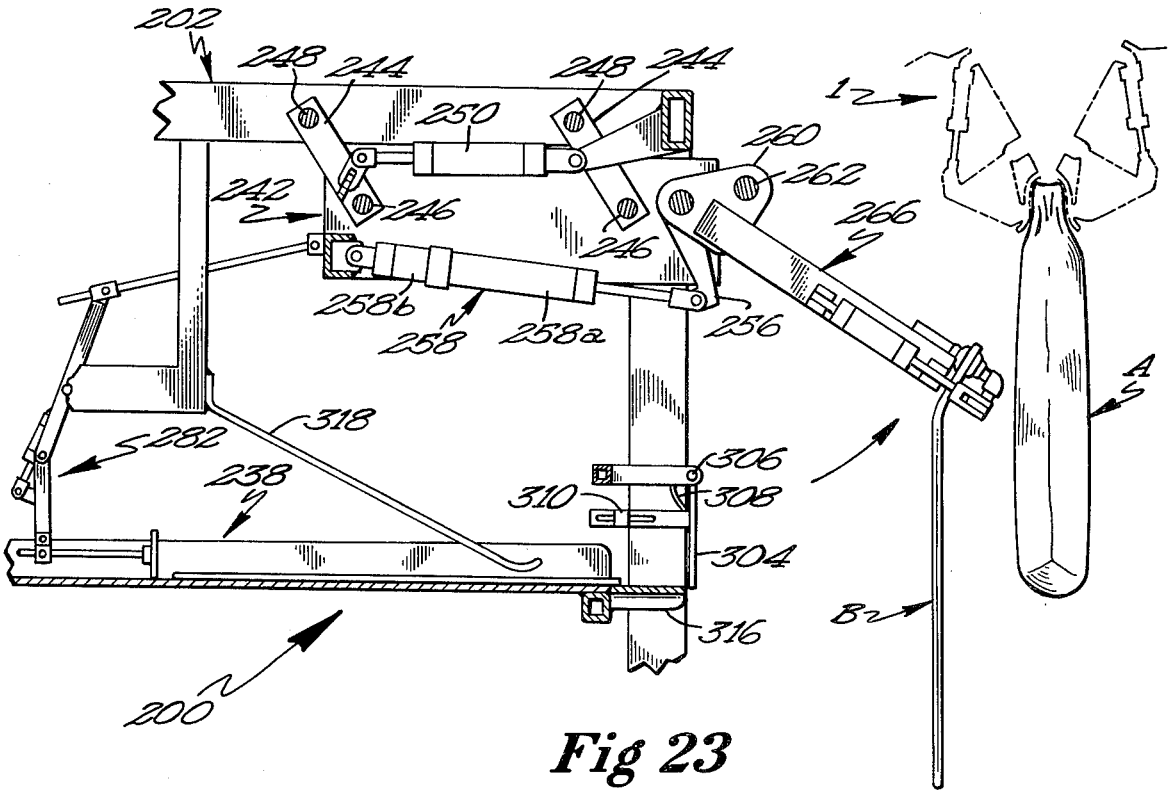

Turning to FIG. 23, carriage cylinder 250 retracts thereby swinging the carriage 242 outwardly while at the same time the first stage 258*a* of two-stage cylinder 258 extends, thereby swinging hanger arms 266 outwardly and upwardly thereby placing bag B closely adjacent to spout 2 which is in the process of finishing the filling of bag A thereon. As this happens, pusher plate 302 has moved to the left of FIG. 23 while at the same time pusher cylinder 294 has extended. This thus places the pushing mechanism 282 in position for a new bag.

Figure 24:
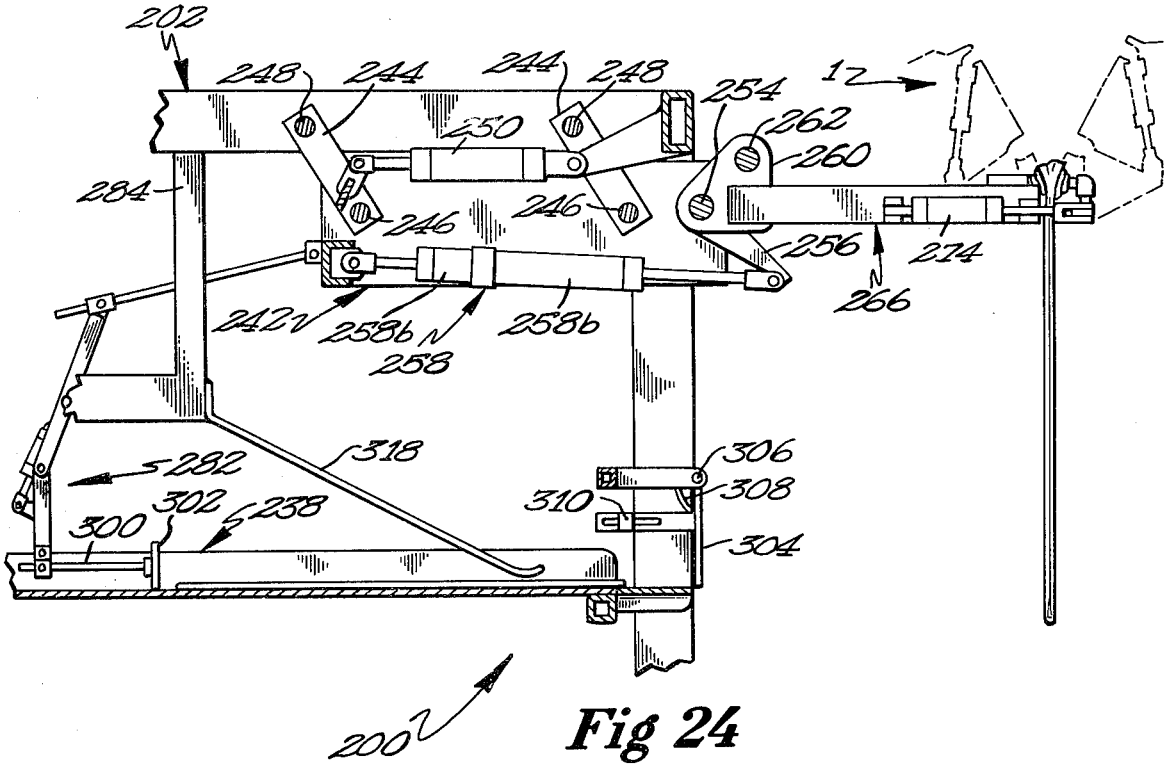

Turning to FIG. 24, as the filling mechanism finishes filling bag A and conveys it away, a new bag C is dropped by swing-arm 212 down chute 236 onto table 238. At the same time, the second stage 258*b* of cylinder 258 extends, thereby placing bag B in position on spout 2 where it may be gripped and clamped as will be more fully described hereinafter. As soon as the gripping at spout 2 has taken place, gripper cylinders 274 retract thereby releasing clamping arms 272.

Figure 5:
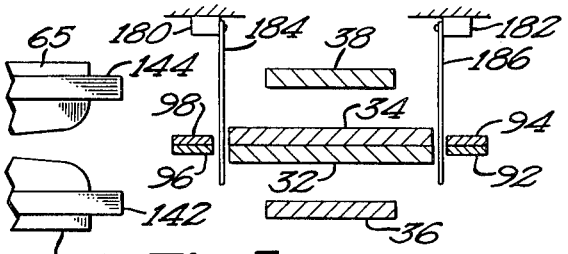
FIGS. 5 through 12 are fragmentary, partially diagrammatic plan views taken along a horizontal plane extending through the discharge end of the filling spout and showing the sequential positioning of the bag clamps, gusset clamping fingers and forming bars in the course of a bag filling and handling cycle.
Figure 25:
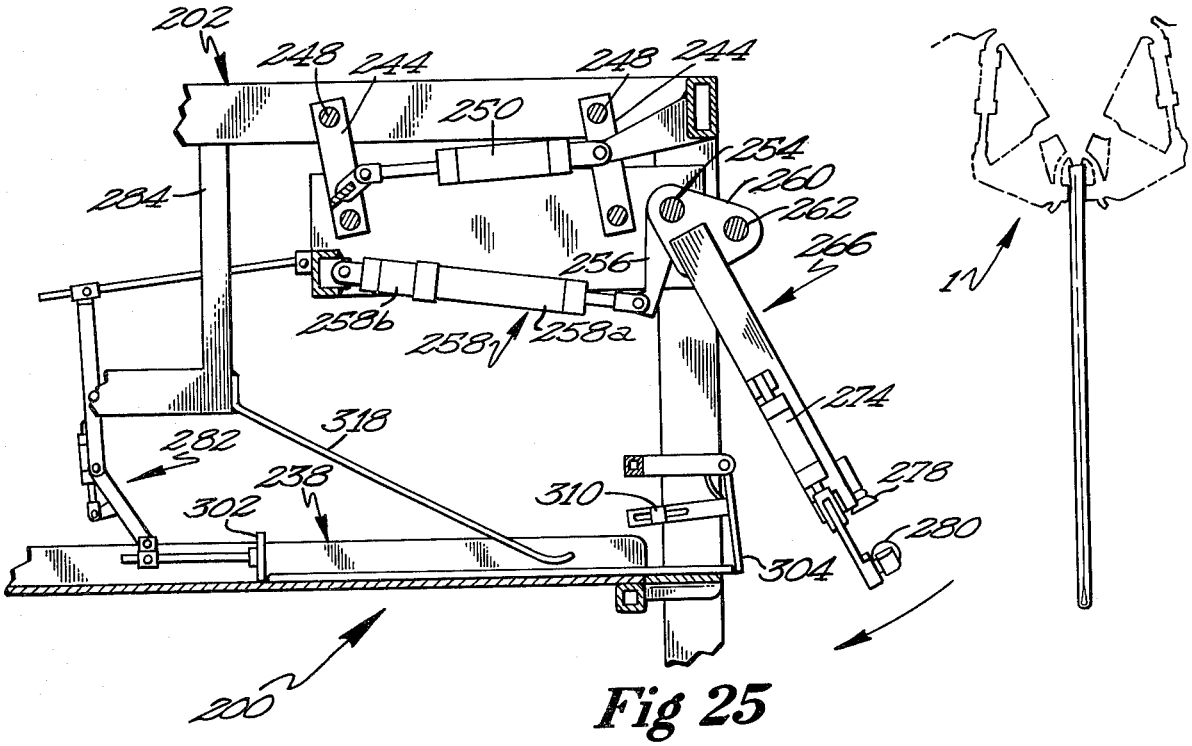

In FIG. 5, it can be seen that carriage cylinder 250 is in the process of extending and both stages of hanger cylinder 258 are in the process of retracting. As this happens, the return of carriage 242 towards the position shown in FIG. 15 causes pusher plate 232 to push bag C forward against registry plate 304. Registry plate 304 is then pushed slightly outwardly as shown in FIG. 25. This is important in assuring proper registration of the bag. Since the length of the bags can vary, it is important that the leading edge of the bag be at a consistent and precise location relative to the clamps. Shortly after bag C has hit registry plate 304, pusher cylinder 294 retracts thereby withdrawing the pusher plate 302 from the trailing edge of the bag C. Thence, as cylinder 258 completes retraction, hanger arms 266 hit arms 310 attached to registry plate 304 thereby pushing registry plate 304 against stop 308 thereby yielding a perfectly registered bag.

As mentioned previously, rather than using registry plate 304, one or more photocells 312 may be placed at the desired registry position such that when the bag reaches that position, photocells 312 activate bumper stops 314 which extend to halt the bag at its desired location.

OPERATION OF THE INVENTION

Figure 6:
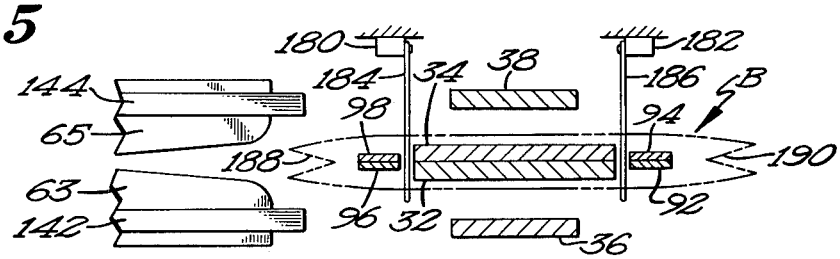
Figure 7:
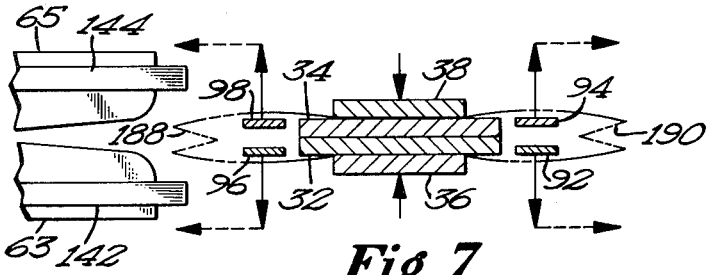
Figure 8:
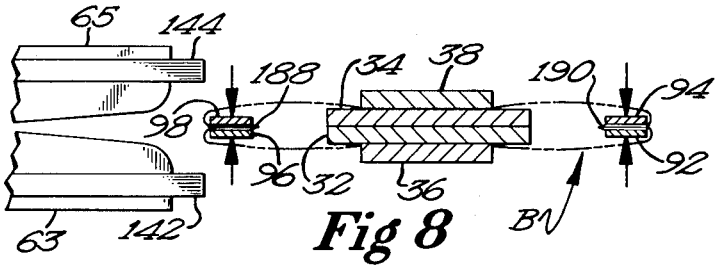

The coordinated operation of gusset arms 88 and 90, gusset clamping fingers 92, 94 and 96, 98 and top forming bars 142 and 144 in the course of a bag filling and handling operation may best be understood by reference to FIGS. 5 through 14. These figures illustrate sequentially the selective positioning of these elements as a bag is placed on spout 2, filled, removed, and conveyed to bag closing machine 62. At the start of a bag filling and handling cycle, the clamping and handling components will be in the positions shown in FIG. 5. Forming bars 142 and 144 will initially be in their rest position laterally spaced from spout 2 adjacent to bag closing machine 62 as shown in FIG. 1. Bag clamps 36 and 38 will be open and spout closure plates 32 and 34 will be closed. Gusset clamping fingers 92 and 94 are initially positioned as shown in FIG. 5 at their laterally inwardly shifted locations close to the side walls of spout 2. At this time, clamping fingers 92, 94 and 96, 98 are closed. A bag B is then placed on the bottom, discharge end of spout 2 with its mouth open and its front and rear faces extending upwardly over the outside of spout closure plates 32 and 34. When a bag is raised to this location and evenly and squarely positioned on the bottom end of spout 2, its top edges will engage sensing fingers 184 and 186 of air valves 180 and 182. These valves are connected in pressurized air lines which form a part of a pneumatic control system for operating all of the power cylinders and clamp actuating cylinders of the apparatus. The tripping of air valves 180 and 182 by the placement of a bag on the spout actuates bag clamping cylinders 50 and 52 so as to move clamps 36 and 38 inwardly so as to grip the top faces of a bag against spout closure plates 32 and 34 forming a part of the bag clamp devices. FIG. 6 shows a bag B moved into filling position on spout 2, and FIG. 7 shows the bag clamped, with bag clamps 36 and 38 having pivoted inwardly. At this same time, clamping fingers 92, 94 and 96, 98 are moved apart and then shifted laterally outwardly sequentially by cylinders 106, 116, and 118, as illustrated in FIG. 7. At their outwardly shifted positions as illustrated in FIG. 8, clamping fingers 92, 94 and 96, 98 will be positioned at the upright, gusseted sides 188 and 190 of a gusseted bag B. FIG. 8 further illustrates the next sequentially controlled step wherein gusset fingers 92, 94 and 96, 98 are pivoted inwardly into clamping engagement with gussets 188 and 190.

It is to be noted by reference to the directional arrows in FIGS. 7 and 8 that clamping fingers 92, 94 and 96, 98 are shifted laterally by cylinders 116 and 118 in a direction which is generally perpendicular to the clamping path of movement of bag clamps 36 and 38. The path of movement of clamping fingers 92, 94 and 96, 98 to grip and release the bag gussets is in a direction generally parallel to the path of movement of bag clamps 36 and 38. Clamping fingers 92, 94 and 96, 98 are initially positioned as shown in FIG. 5 so that they will extend downwardly inside of bag B when the bag is mounted on the discharge end of spout 2. Thus, when these clamping fingers engage the bag gussets 188 and 190 as shown in FIG. 8, they will grip and hold the gusset pleats on the inside of the bag. This ensures that the bag mouth may be distended to the maximum extent possible when spout 2 is opened in contrast with the clamping of the gusseted sides of the bag on the outside of the bag.

Figure 9:
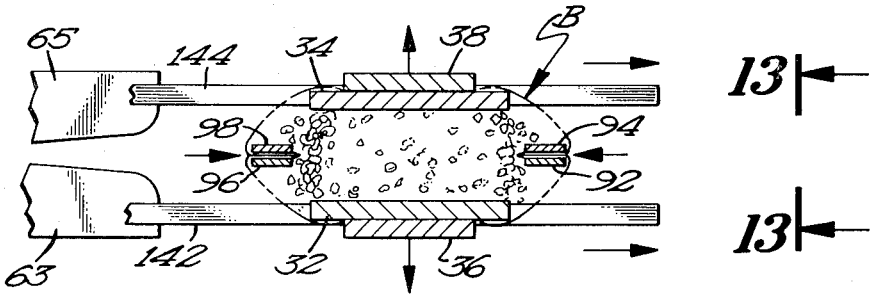
Figure 13:
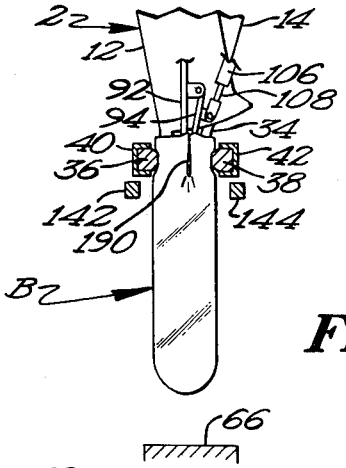
FIG. 13 is a fragmentary end view of the bag filling apparatus taken along lines 13—13 of FIG. 9.

FIG. 9 illustrates the next sequence of movements which take place as the spout opens. The sequentially controlled actuation of spout cylinder 20 after the gusset pleats are gripped by clamping fingers 92, 94 and 96, 98 causes spout clam shells 12 and 14 to swing apart to the open position shown in FIG. 4. This carries spout closure plates 32 and 34 to the open position shown to permit the dispensing of particulate material into bag B. Bag clamps 36 and 38 will of course be carried outwardly with clam shells 12 and 14, and will thus continue to clamp the bag as it is opened for filling. The open bag is illustrated in FIG. 9 with particulate material therein. Simultaneously with the opening of spout 2, gusset arms 88 and 90 will be shifted laterally inwardly by cylinders 116 and 118 to carry clamping fingers 92, 94 and 96, 98 to the inwardly disposed positions shown in FIG. 9. This action permits the gusseted sides 188 and 190 of bag B to be drawn inwardly as the front and rear faces of the bag are spread apart by the opening action of spout 2. Thus, clamping fingers 92, 94 and 96, 98 serve to support the gusseted sides of the bag in an upright position from within the bag with the bag distended to the maximum extent possible, while holding the pleated form of the gusseted sides of the bag as the bag is being filled. In the stage of operation illustrated in FIG. 9, forming bars 142 and 144 have also traversed laterally from the rest position shown in FIGS. 1 and 5 by the action of traversing cylinder 172 in retracting its piston 170. In this step forming bars 142 and 144 have been moved to a position directly under spout 2 in embracing juxtaposition to the front and rear faces of bag B. Forming bars 142 and 144 are now positioned at an elevated level which is below clamping fingers 92, 94 and 96, 98 as well as below bag clamps 36 and 38 as illustrated in FIG. 13.

Figure 10:
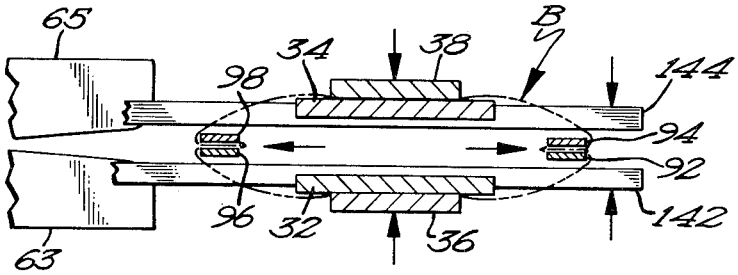

In response to the filling of bag B with a predetermined charge of material as sensed by a timer or time delay incorporated in the control system, spout plates 32, 34 start to close, gusset clamping fingers 92, 94 and 96, 98 are shifted laterally outwardly, and forming bars 142, 144 are pivoted inwardly towards each other by their respective power and actuating cylinders. These simultaneous movements are illustrated in FIG. 10.

Figure 11:
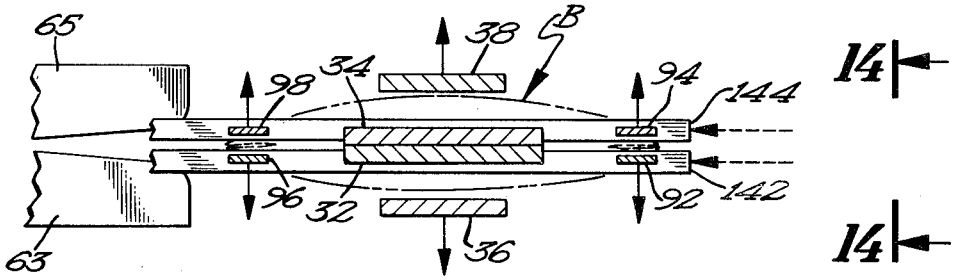
Figure 14:
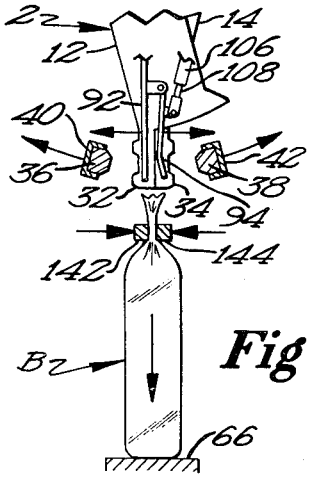
FIG. 14 is a fragmentary, end view of the bag filling apparatus taken along lines 14–14 of FIG. 11.

The next series of movements is illustrated in FIGS. 11 and 14. At this stage, top forming clamps 142 and 144 have been pivoted fully inwardly into gripping engagement with the front and rear faces of bag B across its entire width. It is to be noted that forming clamps 142 and 144 are of a sufficient length to extend fully across the width of any size bag to be filled. As forming clamps 142 and 144 grip the neck of the bag, gusset clamping fingers 92, 94 and 96, 98 are in their fully outwardly shifted positions at the gusseted sides of the bag. This ensures that bag B has again been extended to its full width at the instant of gripping by forming clamps 142 and 144. In this manner, the gusset clamping fingers and forming clamps cooperate to hold and form the gusseted sides of a bag in flattened, gusset pleats prior to the movement of the bag to a bag closing station. FIG. 14 shows how forming bars 142 and 144 press the front and rear faces of the bag together in flattened positions for introduction into bar sewing machine 62.

In response to the gripping of the filled bag neck by forming bars 142 and 144, gusset clamping fingers 92, 94 and 96, 98 are moved apart to release the gusset pleats 188 and 190 and thereafter shifted laterally inwardly to their first or rest positions shown in FIG. 5. Simultaneously, bag clamps 36 and 38 are opened by cylinders 50 and 52 as illustrated in FIGS. 11 and 14. Sequentially, forming bars 142 and 144 are moved downwardly by the actuation of cylinder 160 to controllably lower bag B onto conveyor segment 66 as shown in FIG. 14.

Thereafter, conveyors 66 and 68 are operated to carry the filled bag laterally to the input side of bag closing machine 62. Simultaneously, forming bars 142 and 144 are traversed laterally by the extension of piston 170 in a direction generally parallel to that of the conveyors 66 and 68, as indicated by the dotted arrows in FIGS. 11 and 1. Forming bars 142 and 144 thus continue to grip and support the filled bag as it is transported on conveyors 66, 68 towards the bag closing machine 62. The continued, clamping engagement of forming bars 142 and 144 with the top of the filled bag further ensures that the top of the bag will be presented in a flat, properly gusseted manner between guide chains 64 for introduction to sewing machine 62. Sewing machine 62 stitches the top of the bag closed in a well known manner. It is to be noted however that other types of bag closing devices may be utilized.

Figure 12:
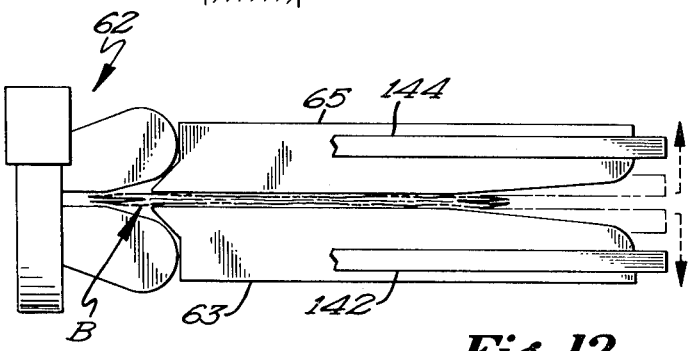
Figure 12:
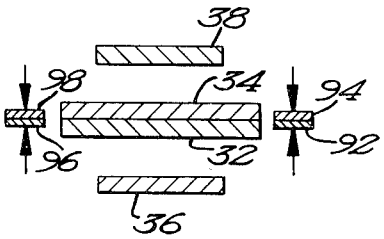

Upon the full extension of traversing cylinder 170 and the resultant delivery of bag B to the inlet of bag closing machine 62 as illustrated in FIG. 12, forming clamps 142 and 144 are pivoted to their open position by cylinder 174. Sequentially, forming bars 142 and 144 are raised upwardly to their final, rest position by cylinder 160. Simultaneously, clamping fingers 92, 94 and 96, 98 are pivoted together in their closed positions as illustrated in FIG. 12. This final series of movements completes a cycle, and all of the component parts are again in the start-up position illustrated in FIG. 5.

From the foregoing description, it will be appreciated that the apparatus set forth herein accomplishes the fully controlled handling of bags from a filling spout to a bag closing machine. Also, the gusset arms and their clamping fingers are sequentially controlled and actuated in such a way in cooperation with the opening and closing of spout 2 as to maintain the gusseted sides of a bag in properly formed, gusset pleats throughout the filling cycle. Any type of gusseted bag may be utilized with the bag filling and handling apparatus disclosed herein. For example, pinch bottom bags having gusseted sides could be filled and handled on this apparatus. For such bags, the bag sewing machine 62 at the closing station would be replaced by a pinch top sealer which would be operative to fold and seal the tops of pinch bottom bags after filling on spout 2.

It is anticipated that various changes may be made in the construction, arrangement and operation of the component parts and apparatus disclosed herein without departing from the spirit and scope of the invention as defined by the following claims.

What is claimed is:

1. An automatic bag hanger for handling and accurately hanging bags to be filled on a filling apparatus comprising gripping means, said hanger comprising:

means for picking a bag to be filled off a stack of bags;

means for transferring said bag from said picking means to a registry position; and hanging means for hanging said bag on said filling apparatus from said registry position, said hanging means comprising a first moving means movable between a first position adjacent said registry position and a second position closely adjacent to and spaced from said filling apparatus;

a second moving means for moving said hanging means between said second position and a third position located for filling by said filling apparatus; and clamping means for clamping a bag to said hanging means, said clamping means being independent of said filling apparatus gripping means allowing said clamping means to hold a first bag in said second position waiting to be filled while said gripping means grips a second bag at said filling apparatus during filling, said hanging means maintaining clamping contact continuously from said registry position until said filling apparatus gripping means grips said bag.

2. The automatic bag hanger of claim 1 wherein said filling apparatus comprises:

hopper means containing particulate material to be dispensed into bags;

a spout positioned to receive particulate material from said hopper, said spout having a discharge end operable between open and closed positions for the controlled discharge of particulate material into bags;

first power means positioned and arranged for opening and closing said discharge end of said spout;

clamp means on said spout for holding the mouth of a bag to be filled on said discharge end of said spout;

second power means operatively connected to said clamp means for moving said clamp means between bag clamping and bag release positions;

a pair of vertically oriented arm assemblies positioned on opposite sides of said spout at locations where they will extend inside of a bag mouth when a bag is clamped on said discharge end of said spout, said arm assemblies being laterally shiftable towards and away from each other in a direction generally perpendicular to the clamping path of movement of said clamp means to selectively engage and hold the opposed, upright sides of a bag in predetermined positions in coordination with the opening and closing of said clamp means for optimum distension and forming of a bag mouth during filling; and third power means connected to said arm assemblies and operable to laterally shift said arm assemblies;

conveyor means positioned below said hopper means for the movement of filled bags to a bag closing station;

a pair of bag gripping and forming bars movably supported on guide means for up and down movement and for back and forth traversing movement in a direction generally parallel to said conveyor means between a rest position laterally displaced from said spout and a position under said spout in embracing juxtaposition to the top end of a bag being filled, said forming bars being further movable towards and away from each other for bag gripping and release;

drive means controllably operable for imparting said up and down and traversing movement to said forming bars in a predetermined sequence, and actuating means for moving said forming bars towards and away from each other, whereby said forming bars are moved from said rest position to said position under said spout at the conclusion of a bag filling operation in embracing juxtaposition to the top end of a filled bag, moved towards each other by said actuating means to firmly grip a filled bag and press its front and rear faces closed at the top end thereof, moved downwardly to controllably lower the filled bag onto said conveyor means and then transversely moved back towards said rest position along said conveyor means to deliver a filled bag with its top end held closed to a bag closing station.

3. The automatic bag hanger of claim 1 wherein said clamping means comprises:

a first clamping means for clamping a first side of said bag adjacent to the top of said bag;

a second clamping means for clamping a second side of said bag adjacent the top of said bag; and suction means for slightly opening the top of said bag while held by said first and second clamping means.

4. The automatic bag hanger of claim 3 further comprising means applying a stretching pressure between said first and said second clamping means.

5. The automatic bag hanger of claim 1 wherein said hanging means further comprises:

a swingable carriage; and first and second clamping arms swingably mounted to said carriage.

6. The automatic bag hanger of claim 5 wherein said first and second clamping arms are directed downward from said carriage toward said registry position when said first moving means is in said first position.

7. The automatic bag hanger of claim 1 further comprising a removable pallet on which said stack is placed.

8. The automatic bag hanger of claim 1 further comprising registry means, said registry means comprising:

a table for receiving a pinch bottom bag from said picking means; and means for pushing the top edge of said bag into said registry position.

9. The automatic bag hanger of claim 8 further comprising:

means for sensing when said bag has reached said registry position; and means for stopping said bag responsive to said sensing means.

10. The automatic bag hanger of claim 8 further comprising:

a hinged stop plate depending downwardly at said registry position, said pushing means having a stroke so as to cause the leading edge of said bag to push said plate slightly outwardly, so that upon retraction of said pushing means, said plate will force said leading edge into exactly said registry position.

* * * * *